/22/78 XR 4,108,680

United States Patent [19]

Barr, Jr.

[11] 4,108,680

[45] Aug. 22, 1978

[54] PROCESS FOR REMOVING CALCIUM OXALATE SCALE

[75] Inventor: James W. Barr, Jr., Rothschild, Wis.

[73] Assignee: Sterling Drug Inc., New York, N.Y.

[21] Appl. No.: 777,968

[22] Filed: Mar. 16, 1977

Related U.S. Application Data

[63] Continuation-in-part of Ser. No. 642,452, Dec. 19, 1975, abandoned.

[51] Int. Cl.[2] ..... B08B 3/08

[52] U.S. Cl. ..... 134/3; 134/41; 252/80; 252/101

[58] Field of Search ..... 134/3, 28, 41; 252/80, 252/100, 101; 162/48

[56] References Cited

U.S. PATENT DOCUMENTS

| | | | |
|---|---|---|---|
| 2,132,511 | 10/1938 | Hentrich et al. | 252/101 |
| 2,774,694 | 12/1956 | Wiggins | 134/3 UX |
| 3,369,935 | 2/1968 | Booth et al. | 134/3 |
| 3,449,164 | 6/1969 | Vinkler et al. | 134/3 |
| 3,518,204 | 6/1970 | Hansen et al. | 134/3 X |

FOREIGN PATENT DOCUMENTS

| | | | |
|---|---|---|---|
| 568,532 | 1/1933 | Fed. Rep. of Germany | 252/101 |

OTHER PUBLICATIONS

Latimer et al., *Ref. Book of Inorganic Chemistry*, 3rd Ed., 1951, pp. 390, 392.

*Hackh's Chemical Dictionary*, 1969, p. 406.

*Chem. Abstracts*, vol. 39, 1945, p. 4154.

*Primary Examiner*—S. Leon Bashore

*Assistant Examiner*—Marc L. Caroff

*Attorney, Agent, or Firm*—Thomas L. Johnson; B. Woodrow Wyatt; William G. Webb

[57] ABSTRACT

A mixture of nitric acid and manganese dioxide is effective in removing calcium oxalate scale from metal surfaces.

4 Claims, No Drawings

PROCESS FOR REMOVING CALCIUM OXALATE SCALE

This application is a continuation-in-part of application Ser. No. 642,452, filed Dec. 19, 1975, now abandoned.

BACKGROUND OF THE INVENTION

1. Field of the Invention

This invention relates to a process for removing calcium oxalate scale from metal surfaces by contacting it with a mixture of nitric acid and manganese dioxide.

2. Description of the Prior Art

Calcium oxalate is a common substituent of scale forming on the metal surfaces of apparatus used for thermal treatment of aqueous solutions and suspensions. It forms most frequently in the tubes of heat exchangers. In the past, calcium oxalate scale has been removed by washing the pipes or tubes with dilute aqueous acid such as hydrochloric acid or nitric acid. However, the calcium oxalate has a very limited solubility in these acids so that repeated washings are necessary, involving a costly and time-consuming operation.

German Pat. No. 568,532, published Jan. 20, 1933, discloses a process for removing "Bierstein", a scale consisting in part of calcium oxalate from aluminum vessels used in the brewery industry, by treating the vessels with nitric acid and an oxidizing agent. The oxidizing agents disclosed are sodium peroxide, chromium trioxide, chromic acid, dichromic acid, chloric acid and permanganic acid salts.

SUMMARY OF THE INVENTION

The process of the invention relates to a method for removing calcium oxalate scale from a metal surface which comprises contacting it with an aqueous mixture containing from 3% to 25% by weight of nitric acid and from 1% to 10% by weight of manganese dioxide, at a temperature between 20° C. and 95° C.

DETAILED DESCRIPTION INCLUSIVE OF PREFERRED EMBODIMENTS

It has been found that a mixture of nitric acid and manganese dioxide is much more effective in dissolving calcium oxalate scale than is nitric acid alone.

Manganese dioxide is essentially insoluble in aqueous nitric acid. However, if calcium oxalate is added to a suspension of manganese dioxide in aqueous nitric acid, the calcium oxalate and manganese dioxide are gradually solubilized by oxidation of the oxalate moiety by the manganese dioxide. At the same time the nitric acid is in part neutralized by the calcium.

In the mixture of nitric acid and manganese dioxide, the nitric acid is present in a concentration of between 3 and 25% by weight and the manganese dioxide is present in a concentration of between 1% and 10% by weight relative to the total mixture. It is used to dissolve the calcium oxalate at a temperature between about 20° C. (room temperature) and 95° C. A preferred mixture is that containing 5% by weight of nitric acid and 2% by weight of manganese dioxide, and a preferred temperature range is 70°-80° C.

Since the concentrations of nitric acid and manganese dioxide will decrease as quantities of calcium oxalate are consumed, additional amounts of nitric acid and manganese dioxide may be added at selected time intervals to restore the original concentrations.

The use of the invention is of course limited to the cleaning of metal surfaces which are compatible with a nitric acid-manganese dioxide mixture. Metals which are not substantially affected by the mixture are titanium and most stainless steels. Metals which are not compatible are aluminum, nickel, copper, and nickel and copper alloys.

Certain precautions should be observed in carrying out the process of the invention. Considerable gas is evolved which can cause foaming and/or pressure buildup unless means for alleviating these conditions are provided. The evolved gas may contain oxides of nitrogen; accordingly, good ventilation should be provided.

The following examples will further illustrate the invention without the latter being limited thereby.

EXAMPLE 1

Five percent aqueous nitric acid was found to dissolve approximately 8 grams per liter of calcium oxalate monohydrate at room temperature. With the addition of 20 grams per liter of manganese dioxide the solubility of the calcium oxalate monohydrate was increased to approximately 32–34 grams per liter, whereupon the concentration of the nitric acid has decreased to less than 2 grams per liter. By continually adding additional nitric acid and manganese dioxide to the same solution it was possible to dissolve calcium oxalate monohydrate to the extent of 200 grams per liter.

EXAMPLE 2

An aqueous mixture containing 32 grams per liter of calcium oxalate monohydrate, 20 grams per liter of manganese dioxide and 5 percent by weight of nitric acid was stirred at room temperature. The solubilized amounts of calcium oxalate monohydrate and manganese dioxide were determined at selected time intervals, as follows:

| Time | $CaC_2O_4 \cdot H_2O$ | $MnO_2$ |
|---|---|---|
| | grams/liter | |
| ½ hour | 7.1 | 0.7 |
| 1 hour | 7.5 | 1.1 |
| 2 hours | 8.9 | 2.2 |
| 3 hours | 10.0 | 3.0 |
| 5 hours | 11.7 | 4.4 |
| 7 hours | 13.7 | 5.8 |
| 7 days | 30.1 | |
| 11 days | 35.4 | 17.5 |

The apparent higher than theoretical concentration of calcium oxalate after 11 days was caused by the periodic removal of aliquots for analysis after allowing the mixture to settle.

EXAMPLE 3

An aqueous mixture containing 65 grams per liter of calcium oxalate monohydrate, 48 grams per liter of manganese dioxide and 5 percent by weight of nitric acid was stirred at 70° C. The solubilized amounts of calcium oxalate monohydrate and manganese dioxide were determined at selected time intervals, as follows:

| Time | $CaC_2O_4 \cdot H_2O$ | $MnO_2$ |
|---|---|---|
| | grams/liter | |
| ½ hour | 32.5 | 15.2 |
| 1 hour | 32.3 | 15.6 |
| 2 hours | 33.6 | 16.0 |
| 5 hours | 34.5 | 16.4 |

-continued

| Time | $CaC_2O_4 \cdot H_2O$ | $MnO_2$ |
|---|---|---|
| | grams/liter | |
| 7 hours | 35.0 | 16.7 |

EXAMPLE 4

An aqueous mixture contining 112 grams per liter of calcium oxalate monohydrate, 50 grams per liter of manganese dioxide and ten percent by weight of nitric acid was stirred at 70° C. The solubilized amounts of calcium oxalate monohydrate and manganese dioxide were determined at selected time intervals, as follows:

| Time | $CaC_2O_4 \cdot H_2O$ | $MnO_2$ |
|---|---|---|
| | grams/liter | |
| 1 hour | 69.6 | 35.5 |
| 2 ½ hours | 71.4 | 36.2 |
| 6 hours | 73.5 | 37.2 |

EXAMPLE 5

An aqueous mixture (260 ml.) containing 200 grams per liter of calcium oxalate monohydrate and 55.3 grams per liter of nitric acid was stirred at 70° C. At selected time intervals selected amounts of manganese dioxide and/or additional nitric acid were added and the amount of solubilized calcium oxalate monohydrate and manganese dioxide determined, according to the following table:

| Time (minutes) | $CaC_2O_4 \cdot H_2O$ grams/liter | $MnO_2$ grams/liter | $HNO_3$ grams/liter | pH | Concd. $HNO_3$ added ml. | $MnO_2$ added grams |
|---|---|---|---|---|---|---|
| 33 | 8.2 | 0 | 54.0 | 0.7 | — | |
| 85 | 7.7 | 0 | 54.0 | 0.7 | — | — |
| 90 | — | — | — | — | — | 5.5 |
| 210 | 26.6 | 14.1 | 6.2 | 1.35 | — | — |
| 227 | — | — | — | — | 10 | — |
| 280 | 38.3 | 14.0 | 42.8 | 0.55 | — | — |
| 285 | — | — | — | — | — | 5 |
| 375 | 60.4 | 27.0 | 3.3 | 1.6 | — | — |
| 380 | — | — | — | — | 10 | 5 |
| 435 | 89.0 | 43.6 | 4.1 | 1.25 | — | — |
| 440 | — | — | — | — | 10 | 5 |
| 560 | 118.0 | 60.6 | 2.2 | 1.65 | — | — |
| 590 | — | — | — | — | 20 | — |
| 1340 | 217.8 | 99.8 | 10.3 | — | — | — |

The apparent higher than theoretical concentration of calcium oxalate after 1340 minutes was caused by the periodic removal of aliquots for analysis after allowing the mixture to settle.

In the foregoing examples, the solubilized calcium and magnesium are measured in terms of calcium oxalate monohydrate and manganese dioxide, respectively, even though they have undergone chemical transformation in the process.

A corrosion study was performed in order to determine the corrosion behavior of aluminum and stainless steel in the following solutions:

1. 10% nitric acid with 20 g/1 of manganese dioxide
2. 20% nitric acid with 175 g/1 of sodium bichromate
3. 20% nitric acid with 40 g/1 of potassium permanganate.

Testing was conducted at two temperatures, 25° C. and 70° C. In order to determine the effect of soluble chlorides, each condition was repeated with the addition of 500 ppm of chloride ion. The corrosion testing was accomplished using potentiodynamic polarization techniques. The corrosion rates, reported in mils of penetration per year (mpy), were calculated from experimentally determined corrosion currents. A rough estimate of the maximum acceptable rate is 20 to 30 mpy.

The results are given in the following table:

| Solution No. | Temperature | Chloride Addition | Material | Corrosion Rate |
|---|---|---|---|---|
| 1 | 25° C | None | 6061T6 Al | 94 mpy |
| 1 | 25° C | 500 ppm | 6061T6 Al | 39 mpy |
| 1 | 70° C | None | 6061T6 Al | 3100 mpy |
| 1 | 70° C | 500 ppm | 6061T6 Al | 1900 mpy |
| 1 | 25° C | None | 316 S.S. | 22 mpy |
| 1 | 25° C | 500 ppm | 316 S.S. | 39 mpy |
| 1 | 70° C | None | 316 S.S. | 20 mpy |
| 1 | 70° C | 500 ppm | 316 S.S. | 23 mpy |
| 2 | 25° C | None | 6061T6 Al | 0.7 mpy |
| 2 | 25° C | 500 ppm | 6061T6 Al | 8.6 mpy |
| 2 | 70° C | None | 6061T6 Al | 6.5 mpy |
| 2 | 70° C | 500 ppm | 6061T6 Al | 7.7 mpy |
| 2 | 25° C | None | 316 S.S. | 1.4 mpy |
| 2 | 25° C | 500 ppm | 316 S.S. | 1.1 mpy |
| 2 | 70° C | None | 316 S.S. | 0.9 mpy |
| 2 | 70° C | 500 ppm | 316 S.S. | 2.1 mpy |
| 3 | 25° C | None | 6061T6 Al | 60 mpy |
| 3 | 25° C | 500 ppm | 6061T6 Al | 210 mpy |
| 3 | 70° C | None | 6061T6 Al | 3900 mpy |
| 3 | 70° C | 500 ppm | 6061T6 Al | 3700 mpy |
| 3 | 25° C | None | 316 S.S. | 480 mpy |
| 3 | 25° C | 500 ppm | 316 S.S. | 470 mpy |
| 3 | 70° C | None | 316 S.S. | 440 mpy* |
| 3 | 70° C | 500 ppm | 316 S.S. | 25 mpy* |

*Note: Reduction of $MnO_4^-$ to $MnO_2$ occurred.

The results showed that solution No. 1 was not suitable for washing aluminum but is suitable for washing stainless steel at either 25° C. or 70° C.; solution No. 2 is suitable for washing either aluminum or stainless steel at these temperatures; and solution No. 3 is not suitable for washing aluminum or stainless steel at either 25° C. or 70° C.

I claim

1. A process for removing calcium oxalate scale from a metal surface of an apparatus used for thermal treatment of aqueous solutions and suspensions which comprises contacting said scale with an aqueous suspension containing from 3% to 25% by weight of nitric acid and from 1% to 10% by weight of manganese dioxide, at a temperature between 20° C. and 95° C., said metal surface being one for which the rate of corrosion caused by said suspension is less than about 30 mils of penetration per year.

2. A process according to claim 1 wherein the metal is stainless steel or titanium.

3. A process according to claim 1 wherein additional nitric acid and manganese dioxide are added at selected time intervals to restore the original concentrations of nitric acid and manganese dioxide.

4. A process according to claim 1 wherein the nitric acid content is about 5% by weight and the manganese dioxide content is about 2% by weight.

* * * * *